United States Patent [19]

Jalowsky

[11] Patent Number: 4,517,910

[45] Date of Patent: May 21, 1985

[54] EMBROIDERED DESIGN FOR SECUREMENT TO AN ARTICLE AND METHOD OF MAKING THE SAME

[75] Inventor: Lewis Jalowsky, Arecibo, P.R.

[73] Assignee: Joy Insignia, Inc., Guttenberg, N.J.

[21] Appl. No.: 366,193

[22] Filed: Apr. 7, 1982

[51] Int. Cl.[3] ..... D05C 3/00; D05C 17/00; A41D 27/08

[52] U.S. Cl. ..... 112/439; 2/244; 112/266.1

[58] Field of Search ..... 112/439, 266.1; 158/148; 2/244

[56] References Cited

U.S. PATENT DOCUMENTS

| | | | |
|---|---|---|---|
| 1,063,734 | 6/1913 | Reis | 2/244 |
| 1,117,964 | 11/1914 | Day | 2/244 |
| 1,124,803 | 1/1915 | Reis | 2/244 |
| 1,221,440 | 4/1917 | Gottschalk | 2/244 |
| 1,893,422 | 1/1933 | Levenson | 2/244 |
| 4,103,634 | 8/1978 | Schachter | 112/266.1 |
| 4,140,563 | 2/1979 | Sernaker | 112/266.1 |

FOREIGN PATENT DOCUMENTS

| | | | |
|---|---|---|---|
| 466488 | 5/1937 | United Kingdom | 2/244 |

*Primary Examiner*—Doris L. Troutman
*Attorney, Agent, or Firm*—Henry R. Lerner

[57] ABSTRACT

An embroidered design adapted to be heat sealed to another article. The design is embroidered on a substrate made of woven polyester fabric. The substrate is bonded at the underside thereof to a low melt thermoplastic adhesive film to form a lamination. The design is thereafter traced along the outer and inner peripheries thereof with a severing tool to remove all portions of the lamination except only the design proper consisting of the embroidering thread and the plastic film portions thereunder. The design may then be heat sealed to another article such as a garment with the garment proper being exposed between adjacent portions of the thread to simulate a design embroidered directly onto the garment.

9 Claims, 8 Drawing Figures

FIG. 1
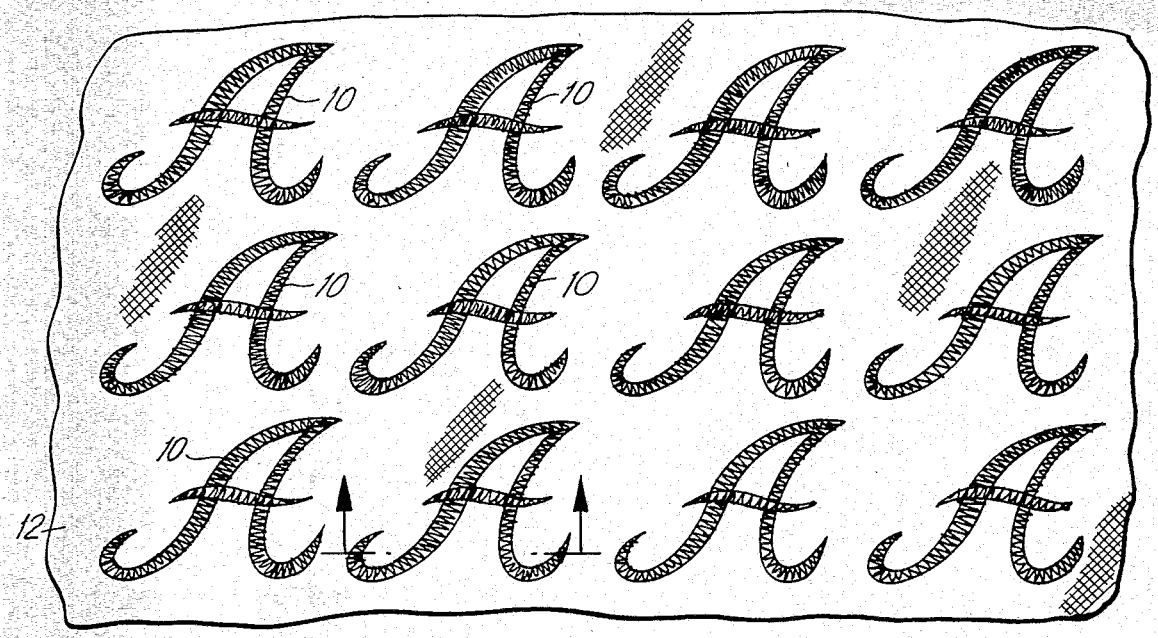
FIG. 2
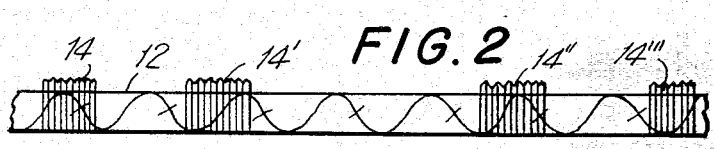
FIG. 3
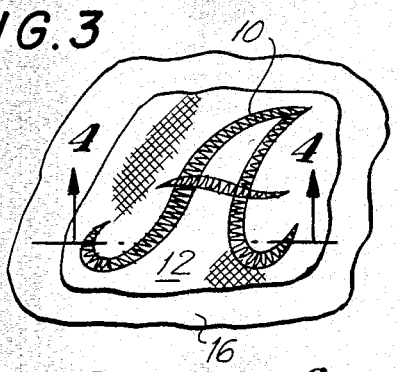
FIG. 4
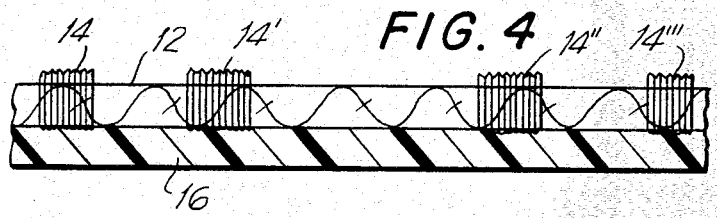
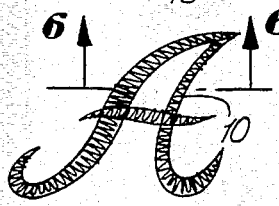
FIG. 5
FIG. 6
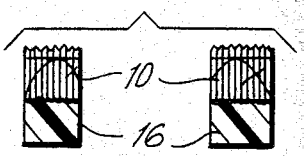
FIG. 7
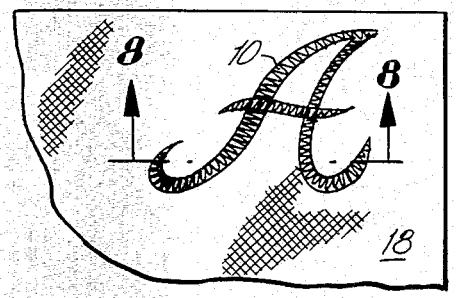
FIG. 8
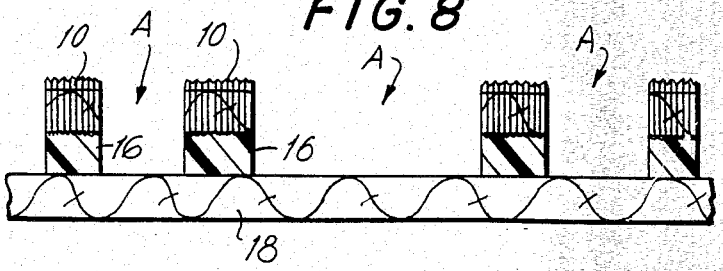

EMBROIDERED DESIGN FOR SECUREMENT TO AN ARTICLE AND METHOD OF MAKING THE SAME

BACKGROUND OF THE INVENTION

The present invention relates to an improved embroidered emblem for securement to another article such as a garment or a handkerchief, as well as the method of making such embroidered emblem for securement to such other article.

Embroidered emblems have gained tremendous popularity in recent times, particularly for the purpose of decorating articles of clothing such as shirts, women's negligees and other intimate apparel, etc.

An embroidered design attached to a garment is most attractive when the only visible part thereof is the embroidering thread creating the design, with the garment proper being exposed in the spaces between adjacent portions of the design. Thus, where a design consists of an initial, it is highly desirable to have the letter forming the initial defined by the embroidering thread while the spaces between adjacent thread portions expose the garment proper.

The above desirable effect is conventionally obtained by two possible methods. In accordance with one of these methods, the design is embroidered directly onto the garment. This method, however, is highly cumbersome and expensive as it requires each embroidering operation to be individually performed on the garment, at a specific location, precluding any possibility of mass production at a reasonable cost.

The other conventional method for producing an embroidered design on an article of wearing apparel which has the same highly attractive appearance is to embroider such design on a gauze-like material, which material is thereafter readily dissolvable so as to leave only the embroidering thread which defines the design. Thereafter the embroidered design can be sewed onto the article to which it is intended to be applied. This method is equally cumbersome and expensive and does not lend itself to any kind of mass production.

In view of the high cost of the above methods, it has been the practice to embroider a design directly onto an opaque patch which is laminated to a heat sealable film so that the patch may in turn be secured, by heat sealing, onto the article. While this procedure is far more economical than those described above, the utilization of the opaque patch creates a far inferior aesthetic impression than where the embroidering thread defining the embroidered design is all that is secured to the article. Thus, where a patch is used, the spaces between adjacent portions of the design are opaque and conceal the true characteristics of the underlying garment, detracting significantly from the overall appearance of the article. While this prodedure has found some acceptance where designs have been embroidered on denim patches for subsequent securement to blue jeans, it has not found any acceptance with more refined type of embroidered designs such as initials or other delicate ornamentation (flowers, butterflies, etc.), for securement to more intimate articles such as negligees, blouses, handkerchiefs, made of delicate materials such as sheer nylon and similar fabrics.

An example of the prior art which attempts to solve the problem of mass producing embroidered emblems for securement to other articles is shown in U.S. Pat. No. 3,657,060 and U.S. Pat. No. 3,816,211. In accordance with these patents, the design is embroidered onto a woven fabric backing material to which there is laminated a thermoplastic film which fuses with the backing material and which also is fusable, upon application of heat and pressure, onto the article of wearing apparel. The thermoplastic film is of such nature as to require the application of high temperatures in the range of 300° to 375°, both for bonding the thermoplastic film to the backing material and for bonding the resulting laminate to the article. Such temperature ranges, if applied to sheer fabrics of the type discussed above, would cause the latter to be damaged and lose its normal characteristics.

It follows, therefore, that, when intended to be applied to sheer fabrics, the woven fabric must be opaque to conceal the underlying garment portions whose normal appearance has been marred by the high temperature. It also is evident that there is no longer the appearance of the design having been embroidered directly onto the base fabric on the underlying garment.

Attempts have been made to overcome the disadvantages which exist in the method described in U.S. Pat. No. 3,816,211. More specifically, my prior application Ser. No. 632,868 filed November 17, 1975, now abandoned, as well as U.S. Pat. No. 4,140,563 disclose a method wherein the design is embroidered directly on a substrate made of a sheer transparent woven material, the underside of which is laminated to a layer or film of adhesive having a melting point which is lower than that of delicate fabrics. The lamination is thereafter die cut along a contour which contains therewithin the embroidered design as a whole without regard to the specific outline of the design, whereby the transparent layer formed by the bonding of the substrate and adhesive film extends between spaced portions of embroidery thread forming the design.

The die cut lamination, which defines the embroidered emblem is now secured to the base fabric (underlying garment) by the application of heat and pressure. Since the adhesive film melting point is lower than that of the base fabric, even where it is a delicate sheer fabric, no damage is done thereto. Further, since the lamination is transparent, the characteristics of the underlying base fabric are visible through the lamination to give the appearance of an embroidered design directly sewn or embroidered thereon.

While this method constitutes a vast improvement it still leaves something to be desired insofar as successfully simulating a design embroidered or sewn directly onto the base material. More specifically, the substrate and film lamination which overlies the base fabric between adjacent portions of embroidery thread, does alter the true appearance of the base fabric, particularly where such base fabric is other than white. The net result is that there is no effective simulation of directly embroidered designs where these are bonded to underlying garments which are not white.

SUMMARY OF THE INVENTION

The present invention relates to a novel method for producing an embroidered design, in mass production, which is capable of being heat sealed to another article and which, when so secured, will simulate an embroidered design either embroidered directly onto such article or secured thereto by stitching.

In accordance with the invention the design is initially embroidered directly onto a substrate which is preferably a woven polyester fabric. Thereafter, the substrate with the design embroidered thereon, is laminated to a low melting thermoplastic film having a melting point between 250° F. and 350° F. The resulting lamination is then cut into a manageable size and, using a heated electrical soldering iron, the design is traced along the inner and outer peripheries thereof removing all portions of the substrate and film lamination except only those portions located immediately beneath the embroidered yarn. Thereafter the embroidered pattern is heat sealed onto a base fabric, such being made possible by the adhesive film beneath the embroiderey yarn with the application of heat and pressure. Since all that is bonded to the base fabric is the embroidered pattern, there being no laminate left in the open spaces of the pattern, the result clearly simulates a design embroidered directly onto the base fabric.

BRIEF DESCRIPTION OF THE DRAWINGS

FIG. 1 is a plan view of a plurality of initials embroidered on a substrate;

FIG. 2 is a section, on an enlarged scale, taken along line 2—2 of FIG. 1;

FIG. 3 is a plan view of a single initial after the substrate has been laminated with a thermoplastic film;

FIG. 4 is a section, on an enlarged scale, taken along line 4—4 of FIG. 3;

FIG. 5 is a plan view of the embroidered design of FIG. 3 after all excess material has been severed therefrom FIG. 6 is a section, on an enlarged scale, taken along line 6—6 of FIG. 5;

FIG. 7 is a plan view of the design of FIG. 6 after it has been heat sealed to another article; and FIG. 8 is a section, on an enlarged scale, taken along line 8—8 of FIG. 7.

DESCRIPTION OF THE PREFERRED EMBODIMENT

Referring to FIG. 1 there is shown a plurality of embroidered designs 10, consisting of the initial "A", embroidered directly with a Schiffli embroidery machine, onto a substrate or base fabric 12. Substrate 12 is preferably a woven polyester fabric of the same color as that of the embroidering yarn, usually rayon, and has a melting temperature in the range of 250° F. to 350° F., which is lower than the melting temperature of the embroidering yarn, which is in the range of 500° F. to 550° F. As shown in FIG. 2 the base fabric 12 extends between adjacent portions 14, 14', 14'' and 14''' of the embroidering yarn, forming part of design 10.

After the designs 10 have been embroidered onto base fabric or substrate 12, the underside of the design carrying substrate is laminated to a low melt thermoplastic material 16 by a conventional laminating machine which applies heat and pressure. The plastic material should preferably match the color of substrate 12 and of the rayon embroidering yarn.

The thermoplastic material has a thickness of 3 to 7 mils and a melting point in the range of 250° F. to 300° F. which is well below that of the yarn as well as below the melting temperature of delicate fabrics to which the embroidered design is ultimately intended to be heat sealed.

Following lamination of the plastic material 16 to the substrate, the lamination is cut into a segment of manageable size, consisting of several reproductions of the design, which is placed on a clear glass base. Thus, with the use of a heated electrical iron having a shaped tip, each embroidered initial is traced by the heated tip around the complete outer and inner periphery of the initial "A" in order to remove all portions of the substrate/plastic material laminate, including the inner loop defined adjacent the upper part of the initial "A", except only those portions located immediately beneath the embroidering yarn. This is shown in FIGS. 6 and 7 which illustrate one embroidered initial 10 after all excess substrate/plastic material lamination has been severed. As shown in FIG. 6, the severing operation leaves portions of plastic film 16 bonded to the underside of the design, but only immediately below the embroidering yarn. The electrical iron tip is heated to a temperature which is above the melting point of the substrate/plastic material laminate but below that of the rayon yarn so that the latter cannot be inadvertently damaged during the severing operation.

The severed embroidered initial is now in condition for bonding to another article, such as a handkerchief, by mere application of heat and pressure. FIGS. 7 and 8 illustrate the embroidered initial 10 after it has been bonded to an underlying article 18. As shown in these figures, the only portions of the embroidered design which are visible are those constituted by the embroidering yarn itself, with the spaces between adjacent portions of embroidery yarn, shown by arrows A, exposing the underlying article totally unmarred in any form whatsoever, thus providing the unequivocal appearance of a design embroidered directly onto the underlying article.

The color matching of embroidering yarn, substrate and thermoplastic material, while not necessary, is highly desirable for quality control so that any residue of melted plastic and substrate will not cause discoloration.

In actual production, any substrate which is not removed upon the initial severing step can be burned at a secondary examination by merely engaging the heated tip with the excess substrate which is melted and evaporates. Any remaining minute portions of such excess melts into the embroidered design itself which is the reason for the preferred color matching.

The bonding steps hereabove described are accomplished with the use of conventional platens which apply heat and pressure, such as illustrated in the prior art patents discussed above. Alternately, the severed initial can be bonded to the base article by use of a conventional heated iron so that a consumer can purchase a particular initial and bond it directly to the base article.

Thus it is seen that the method in accordance with the invention provides mass produced embroidered designs adapted to be secured to another article so as to create the unequivocal appearance of a design embroidered directly to such other article.

While there is herein shown and described the preferred embodiment of the invention, it will be understood that the invention may be embodied otherwise than as herein specifically illustrated or described, and that in the illustrated embodiment certain changes in the details of construction and in the form and arrangement of parts may be made without departing from the underlying idea or principles of this invention within the scope of the appended claims.

What I claim is:

1. A method of producing an embroidered design adapted to be heat sealed to another article to simulate a design embroidered directly onto such article comprising the steps of (a) embroidering a design with embroidering thread onto a substrate, said design including an inner loop defined by the inner periphery thereof, (b) laminating to the underside of the substrate a low melt thermoplastic adhesive film to form a substrate and thermoplastic film lamination, (c) tracing the inner and outer periphery of the embroidered design with a severing tool to sever all portions of the lamination including said inner loop, except only the embroidering thread and the lamination portion directly thereunder, whereby there remains only the embroidering thread with lamination thereunder to define the embroidered design proper.

2. A method in accordance with claim 1 wherein the melting temperature of the embroidering thread is greater than that of the substrate and the thermoplastic film.

3. A method in accordance with claim 2, wherein the substrate is a woven polyester fabric having a melting temperature in the range of 250° F. to 350° F. wherein the embroidering yarn is rayon having a melting temperature of 500° F. to 550° F. and wherein the thermoplastic film has a melting temperature of 250° F. to 300° F.

4. A method in accordance with claim 1, wherein the remaining embroidered design proper is thereafter heat sealed to said another article simulating a design embroidered directly onto said another article.

5. An embroidered design adapted to be heat sealed to another article to simulate a design embroidered directly onto such article, said design including an inner loop defined by the inner periphery thereof, comprising, (a) a substrate having said design directly embroidered thereon with embroidering thread, (b) a low melt thermoplastic adhesive film bonded to the underside of the substrate to define a laminate, said laminate having severed therefrom all portions including said inner loop, except only the embroidering thread and the laminate portions thereunder, whereby there remains only said embroidering thread and laminate portion thereunder which defines the embroidered design proper.

6. An embroidered design in accordance with claim 5 wherein the melting temperature of the embroidering thread is greater than that of the substrate and the thermoplastic film.:

7. An embroidered design in accordance with claim 6 wherein the substrate is a woven polyester fabric having a melting temperature in the range of 250° F. to 350° F., wherein the embroidering yarn is rayon having a melting temperature of 500° F. to 550° F., and wherein the thermoplastic film has a melting temperature of 250° F. to 300° F.

8. A method in accordance with any one of claims 1, 2, 3 or 4 wherein the embroidering thread, the thermoplastic film and the substrate are of substantially the same color.

9. An embroidered design in accordance with any one of claims 5, 6 or 7 wherein the embroidering thread, the thermoplastic film and the substrate are of substantially the same color.

* * * * *